US005106126A

United States Patent [19]

Longobardi et al.

[11] Patent Number: 5,106,126

[45] Date of Patent: Apr. 21, 1992

[54] PROCESS PRINTED IMAGE WITH REFLECTIVE COATING

[76] Inventors: Lawrence J. Longobardi, 609 Melba, Encinitas, Calif. 92024; Douglas I. Lovison, 746 Blackhawk Cir., Vista, Calif. 92083

[21] Appl. No.: 619,749

[22] Filed: Nov. 29, 1990

[51] Int. Cl.[5] ..... B42D 15/00

[52] U.S. Cl. ..... 283/94; 283/107; 283/109; 283/110; 283/111; 40/582

[58] Field of Search ..... 283/94, 107, 109, 110, 283/111; 40/582, 583, 615

[56] References Cited

U.S. PATENT DOCUMENTS

| | | | |
|---|---|---|---|
| 1,694,847 | 12/1928 | Donaldson | 427/258 |
| 1,867,314 | 7/1932 | Gurwick | 283/94 |
| 2,065,406 | 12/1936 | Silverman | 40/582 |
| 2,235,791 | 3/1941 | Wohlers | 283/111 |
| 3,751,319 | 8/1973 | Green et al. | 40/615 |
| 4,337,590 | 7/1982 | Jackson | 40/615 |
| 4,597,210 | 7/1986 | Zitrell | 40/615 |
| 4,721,635 | 1/1988 | Helinski | 427/256 |

FOREIGN PATENT DOCUMENTS

| | | | |
|---|---|---|---|
| 298687 | 1/1989 | European Pat. Off. | 283/107 |
| 3247964 | 7/1984 | Fed. Rep. of Germany | 283/107 |

*Primary Examiner*—Timothy V. Eley
*Assistant Examiner*—David P. Bryant
*Attorney, Agent, or Firm*—Nydegger & Associates

[57] ABSTRACT

A display has a transparent plastic substrate and a colored image formed on the substrate. The colored image is formed on the substrate by process printing a large number of small dots, colored red, yellow, and blue, in a predetermined pattern onto the substrate. The red, yellow, and blue ink dots are translucent to visible light. A reflective layer is deposited against the ink layer to reflect light which passes through the ink layer and thereby give the image formed by the ink layer a shiny, metallic appearance. A stratum of opaque white ink is deposited between the reflective layer and preselected portions of the image to block the passage of visible light from the preselected portions to the reflective layer.

12 Claims, 1 Drawing Sheet

PROCESS PRINTED IMAGE WITH REFLECTIVE COATING

FIELD OF THE INVENTION

The present invention relates generally to signs and displays. More particularly, the present invention relates to colored displays which can be used on clothing tags, decals, packaging material, and the like. The present invention particularly, though not exclusively, relates to flat process printed image displays that have portions formed on the displayed image which give an apparent three-dimensional quality to the display.

BACKGROUND OF THE INVENTION

In the area of marketing, displays and designs have been widely used on many products to increase the appeal of the products and thereby make the products more attractive to potential purchasers. For example, fanciful displays and designs have been used for many years on greeting cards, packaging, decals, and the like to enhance the appeal of these products.

Just one of the many types of displays which are commonly used are displays which have a transparent plastic substrate on which a design is formed. As can be readily appreciated, even for this particular type of display there are a large number of different techniques which can be used for forming the desired design on the plastic substrate. Of particular importance to the present invention is the technique known as process printing, of which lithographic process printing and silk screen printing are well-known species.

In its most basic sense, process printing involves forming an image on a substrate by depositing a large number of very small, closely-spaced colored dots onto the substrate. Each of the dots is colored one of the four primary colors, i.e., red, blue, yellow, or black. The desired image is formed on the substrate by selectively depositing the variously colored dots onto the substrate in a predetermined pattern, i.e., a predetermined color combination. This pattern or combination in which the dots are deposited forms the desired image and also establishes the colors of the image.

Typically, when an image is to be formed on a plastic substrate for use as a clothing label, packaging, and the like, the dots are translucent ink and are process printed onto the substrate. It happens, however, that when process printed onto a plastic substrate, the image has a two-dimensional, flat appearance.

The present invention recognizes that the effect of process printed displays can be enhanced by making portions of the display appear metallic and shiny to thereby give the display an apparent three-dimensional appearance and enhance the appeal (and thus the effectiveness) of the display.

Accordingly, it is an object of the present invention to provide a display which uses a plastic substrate with an image process printed thereon that has a three-dimensional quality in its appearance. It is a further object of the present invention to provide a display which has a process printed image wherein portions of the image have a metallic, shiny appearance to provide different textured qualities for the image. Another object of the present invention is to provide a display which has diverse applications and which is cost effective to manufacture.

SUMMARY OF THE INVENTION

A display which can be used as a greeting card, clothing label, decal, packaging material, or the like has a transparent plastic substrate, on which is formed a colored image. The image is formed by process printing a large number of relatively small translucent colored ink dots onto the substrate. In accordance with well-known process printing techniques, e.g., lithographic process printing and silk screen printing, the ink dots are colored yellow, blue, and red, and are deposited onto the substrate in a predetermined pattern to form the desired colored image.

Additionally, a stratum of opaque white ink may be deposited over some of the ink dots to cover preselected portions of the image. Accordingly, those portions of the image which are covered with white ink are substantially opaque to visible light. On the other hand, those portions of the image which are not covered with white ink are substantially translucent to visible light.

A reflective layer is deposited over the translucent ink dots and white ink stratum which form the printed image. This reflective layer is preferably a metalized mylar sheet which is laminated to the substrate against the ink dots and white ink layer. Alternatively, the reflective layer can be a layer of metallic paint which is deposited over the ink image onto the substrate by spraying or by dipping the substrate in a container of the paint. In any case, the effect of the reflective layer is to reflect light which passes through the uncovered translucent portions of the image, thereby giving the uncovered translucent portions of the image a shiny, metallic appearance.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
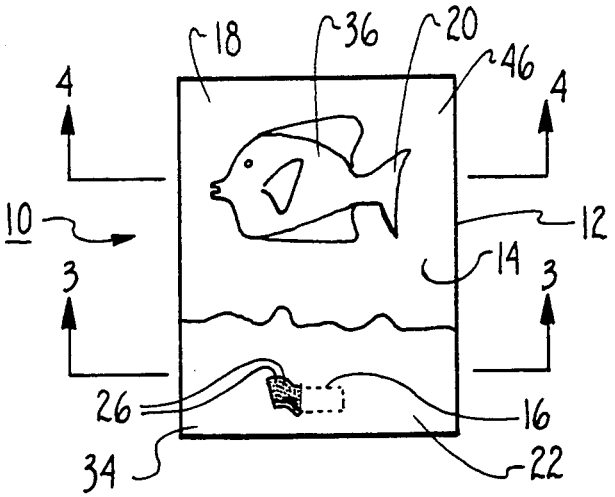
FIG. 1 is a front view of the novel process printed transparent substrate peeled away for clarity.
Figure 3:
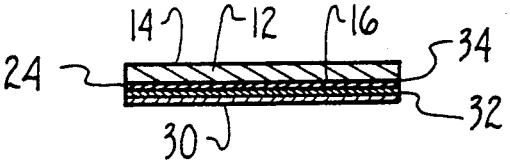
FIG. 3 is a cross-sectional view of the novel process printed display of the present invention as seen along the line 3—3 in FIG. 1.
Figure 4:
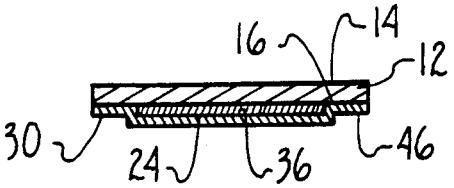
FIG. 4 is a cross-sectional view of the novel process printed display of the present invention as seen along the line 4—4 in FIG. 1.

Referring initially to FIG. 1, a display in accordance with the present invention is shown and generally designated 10. Display 10 includes a transparent substrate 12 which can be made of any suitable material which is transparent or translucent to visible light, such as a plastic sheet or a glass pane. Furthermore, the substrate material can be either rigid or flexible and can be either tinted or clear. In any event, substrate 12 must permit the passage of light in the visible spectrum through substrate 12. As best shown in FIGS. 3 and 4, substrate 12 is formed as a substantially flat sheet having a first surface 14 and an opposite second surface 16.

FIG. 1 also shows that substrate 12 can have any desirable image 18 printed thereon, such as the fish 20 jumping over the waves 22. As seen in cross-reference to FIGS. 1, 3, and 4, image 18 is formed on substrate 12 by depositing a layer 24 of ink onto side 16 of substrate 12.

In accordance with the present invention, the ink which is used for layer 24 is relatively viscous, such as any of the enamel, epoxy or acrylic inks which are well-known in the art, and is curable within a relatively short period of time (e.g., six seconds). More specifically, it is preferred that the ink be curable with ultraviolet (UV) light. Also, it is to be appreciated that the ink which forms predetermined portions of ink layer 24 may be translucent, while the ink that forms other predetermined portions of ink layer 24 may be opaque. Preferably the ink used for the entire layer 24 is translucent.

Figure 2:
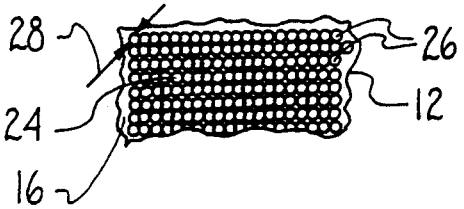
FIG. 2 is a blown-up view of a portion of the display shown in FIG. 1, showing the colored ink dots which form the image on the display.

As shown in FIG. 2, the ink which forms layer 24 is deposited onto substrate 12 as a plurality of relatively small, closely spaced colored ink dots 26. Ink dots 26 are deposited onto substrate 12 by any suitable method of process printing, for example lithographic process printing or silk screen printing. As is well-known in the art, the dots 26 which are printed onto substrate 12 are colored yellow, black, blue, and red, although other colors may potentially be used. Dots 26 are deposited onto substrate 12 in a predetermined color combination which establishes both the shape and color of image 18. It is to be appreciated that the diameter 28 of the dots 26 is preferably small, in order to establish a relatively high degree of resolution of image 18. For example, when using the well-known silk screen process printing, a four hundred (400) line per inch mesh will form dots 26 which have a diameter 28 of approximately twenty-five ten thousandths (0.00025) of an inch. On the other hand, when using lithographic process printing, the diameter 28 of dots 26 can be established to be as small as industrially useful.

Referring now to FIGS. 3 and 4, it can be seen that a reflective layer 30 is deposited against selected portions of ink layer 24 on the side of ink layer 24 opposite substrate 12. More particularly, reflective layer 30 is deposited against the selected portions of ink layer 24 which form the particular portions of the image that are to appear metallic, e.g. fish 20. It is to be understood, however, that reflective layer 30 can also be deposited against the entire ink layer 24 and portions of side 16 of substrate 12 which are not covered by ink layer 24.

In the preferred embodiment, reflective layer 30 is a sheet of metalized mylar which is laminated over ink layer 24 and onto side 16 of substrate 12. Alternatively, reflective layer 30 can be a layer of metallic paint or metallic ink which is sprayed or otherwise deposited onto ink layer 24 and substrate 12. Reflective layer 30 can even be a layer of metallic ink or paint which is deposited onto ink layer 24 and substrate 12 by dipping side 16 of substrate 12 (and, hence, ink layer 24) into a container of the metallic paint or ink which is to form reflective layer 30.

It will be recalled that the ink which forms ink layer 24 is preferably translucent. Accordingly, light can pass through the ink layer 24 and be reflected back through ink layer 24 by reflective layer 30. Thus, those portions of the image 18 which are formed by ink layer 24 have a metallic, shiny appearance. On the other hand, to give preselected portions of ink layer 24 a non-metallic appearance, light can be prevented from being reflected through these preselected portions of ink layer 24. More specifically, light can be prevented from being reflected through preselected portions of ink layer 24 either by forming the preselected portions from opaque ink, or by depositing a non-shiny opaque stratum 32 between the preselected portions of ink layer 24 and reflective layer 30. In either case, light is prevented from being reflected off of reflective layer 30 through the preselected portions. Consequently, the preselected portions do not appear to be metallic.

In the preferred embodiment, opaque stratum 32 is a layer of white ink which is deposited onto the preselected portions of ink layer 24 which are not to be shiny. Opaque stratum 32 will block the passage of light to reflective layer 30 from those portions of ink layer 24 on which the stratum 32 has been deposited. Consequently, those preselected portions of ink layer 24 which have opaque stratum 32 deposited thereon will not appear to be metallic. On the other hand, those portions of ink layer 24 which do not have opaque stratum 32 deposited thereon will have a metallic shiny appearance, as disclosed above. Similarly, the portion 46 of image 18 which is covered by metallic layer 30 but where there is no ink layer 24 will also appear metallic, because light can be reflected through portion 46 by reflective layer 30.

To illustrate, as shown in cross-reference to FIGS. 1 and 4, no opaque stratum 32 is deposited on the portion 36 of ink layer 24, which forms fish 20 of image 18. Also, no opaque stratum 32 is deposited against portion 46 of image 18. Consequently, light can pass through portions 36 and 46 and be reflected back through portions 36 and 46 by reflective layer 30. This gives portion 36 (and, hence, fish 20) and portion 46 a metallic, shiny appearance. On the other hand, as seen in cross-reference to FIGS. 1 and 3, wherever the opaque stratum 32 is deposited between a preselected portion 34 of ink layer 24 and reflective layer 30, any light which passes through portion 34 will be blocked from reflective layer 30 by opaque stratum 32. Thus, portion 34 will not have a metallic appearance.

METHOD OF MANUFACUTURE

Figure 5:
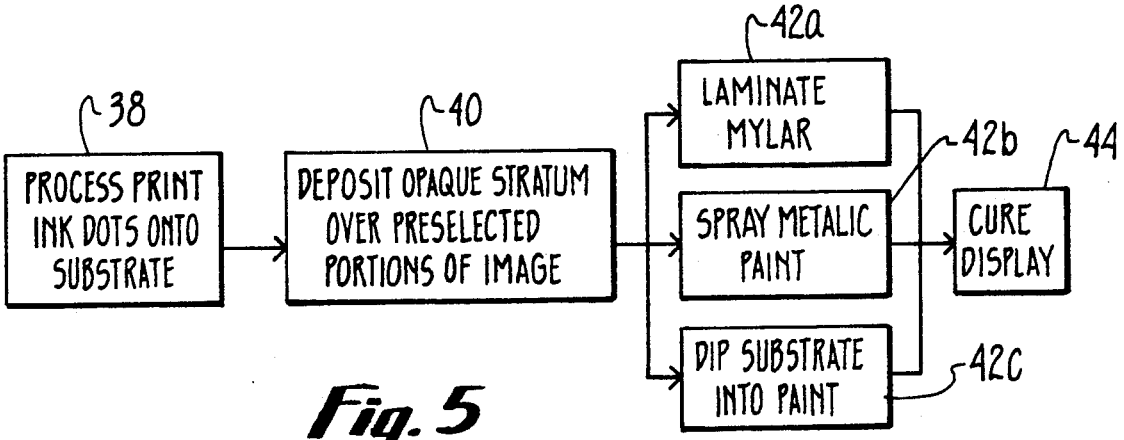
FIG. 5 is a block diagram of the method of manufacturing the novel process printed display of the present invention.

In the method of manufacturing display 10, reference is initially made to FIGS. 2 and 5. In accordance with well-known methods of process printing, including lithographic process printing and silk screen printing, a large number of relatively small, closely spaced colored dots 26 is deposited onto side 16 of substrate 12 to form ink layer 24. This depositing step is indicated at block 38 in FIG. 5. Typically, each dot 26 will be a red, black, yellow, or blue translucent ink dot. The variously colored dots 26 are deposited onto substrate 12 in a predetermined combination, in accordance with well-known methods of process printing, to form the image 18 shown in FIG. 1.

Next, as indicated at block 40, a suitable opaque stratum 2, for example opaque white ink, is deposited over preselected portions of ink layer 24 (e.g., portion 34) which form those portions of image 18 (e.g., waves 22) that are not intended to appear metallic. No opaque stratum 32, however, is deposited against those portions of ink layer 24 (e.g., portion 36) which form portions of image 18 (e.g., fish 20) that are to appear metallic. Stratum 32 may be sprayed, painted, or printed over portion 34 in accordance with well-known ink deposition techniques.

Next, reflective layer 30 is deposited against portions of ink layer 24 which form portions of image 18 that are intended to appear metallic. Additionally, as seen in FIGS. 3 and 4, reflective layer 30 may be deposited against both ink layer 24 and portions of side 16 of substrate 12 which are not covered by ink layer 24, for ease of manufacturing. In any case, reflective layer 30 is preferably a metalized mylar sheet. The mylar sheet which constitutes reflective layer 30 can be laminated or glued onto ink layer 24 and substrate 12. This step is represented at block 42*a*. On the other hand, reflective layer 30 may be a layer of metallic paint which can be sprayed or printed onto ink layer 24 and substrate 12, as indicated at block 42*b* in FIG. 5. Layer 30 in the form of metallic paint can even be deposited against ink layer 24 and side 16 of substrate 12 by gently dipping side 16 of substrate 12 into a container (not shown) of the metallic paint. This step is indicated in FIG. 5 at block 42*c*. In any case, the ink layer 24 is subsequently cured using well-known procedures in the pertinent art. For example, the display 10 can be cured by exposing display 10 to ultraviolet light, as indicated at block 44.

While the particular process printed image with reflective coating as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. A display, which comprises:

a substrate which allows light to pass therethrough, said substrate having a surface;

a color variable ink layer deposited onto said surface of said substrate to form an image, wherein said ink layer is substantially translucent to light;

an opaque stratum deposited onto preselected areas of said ink layer to define masked portions of said ink layer corresponding to said preselected areas and unmasked portions of said ink layer corresponding to the remainder of said ink layer, wherein said areas are preselected relative to the position of said image on said surface of said substrate; and a reflective layer deposited against said ink layer for reflecting light through said unmasked portions to give said unmasked portions a shiny appearance, while said opaque stratum blocks light transmission through said masked portions to give said masked portions a flat appearance.

2. A display as recited in claim 1 wherein said opaque stratum is a layer of opaque white ink.

3. A display as recited in claim 1 wherein said image is process printed onto said substrate by silk screening.

4. A display as recited in claim 1 wherein said image is process printed onto said substrate by lithographic process printing.

5. A display as recited in claim 1 wherein said reflective layer is a layer of metalized mylar, and said metalized mylar layer is laminated against said ink layer and said substrate.

6. A display as recited in claim 1 wherein said reflective layer is a layer of metallic paint, and said metallic paint layer is painted over said ink layer.

7. A display which comprises:

a transparent plastic substrate having a plurality of colored ink dots process printed thereon to form an image, said ink dots being translucent;

an opaque stratum deposited onto preselected areas of said ink dots to define masked portions of said image corresponding to said preselected areas and unmasked portions of said image corresponding to the remainder of said ink dots, wherein said areas are preselected relative to the position of said image on said substrate; and a reflective layer disposed against said masked and unmasked portions to reflect light passing through said unmasked portions, thereby giving said unmasked portions a metallic appearance, while said opaque stratum blocks light transmission through said masked portions to said reflective layer, thereby giving said masked portions a flat appearance.

8. A display as recited in claim 7 wherein said opaque stratum is a layer of opaque white ink.

9. A display as recited in claim 7 wherein said ink dots are deposited onto said substrate by silk screening.

10. A display as recited in claim 7 wherein said ink dots are deposited onto said substrate by lithographic process printing.

11. A display as recited in claim 7 wherein said reflective layer is a metalized mylar sheet laminated against said ink dots.

12. A display as recited in claim 7 wherein said reflective layer is a layer of metallic paint, and said layer of metallic paint is painted over said ink layer.

* * * * *